US006419230B1

(12) United States Patent
Cass

(10) Patent No.: US 6,419,230 B1
(45) Date of Patent: Jul. 16, 2002

(54) SIMULATED BASEBALL GAME AND METHOD

(76) Inventor: Clinton Cass, 20421 Bell Ct., Tehachapi, CA (US) 93561

( * ) Notice: Subject to any disclaimer, the term of this patent is extended or adjusted under 35 U.S.C. 154(b) by 0 days.

(21) Appl. No.: 09/477,826

(22) Filed: Jan. 5, 2000

(51) Int. Cl.[7] ..... A63F 3/02

(52) U.S. Cl. ..... 273/259; 273/244; 273/243; 273/242; 273/288

(58) Field of Search ..... 273/259, 244.1, 273/244, 317.6, 236, 238, 288, 134; 364/410

(56) References Cited

U.S. PATENT DOCUMENTS

| | | | | | |
|---|---|---|---|---|---|
| 367,991 | A | * | 8/1887 | McGill | 273/134 |
| 431,727 | A | * | 7/1890 | Samuels | 273/244 |
| 811,963 | A | * | 2/1906 | Shaules | 237/134 |
| 1,133,125 | A | * | 3/1915 | Gerrard, Jr. | 273/244 |
| 1,150,014 | A | * | 8/1915 | Bourne | 273/244 |
| 1,252,691 | A | * | 1/1918 | Hamel | 273/244 |
| 1,361,616 | A | * | 12/1920 | Reeves | 273/244 |
| 1,544,308 | A | * | 6/1925 | Gelpi | 273/244 |
| 1,741,596 | A | * | 12/1929 | Wright | 273/93 |
| D87,944 | S | * | 10/1932 | Stackhouse | 273/244 |
| 2,234,725 | A | * | 3/1941 | Doerr | 273/93 |
| 2,665,910 | A | * | 1/1954 | Hutchins | 273/88 |
| 2,883,193 | A | * | 4/1959 | Iannone et al. | 273/88 |
| 3,124,356 | A | * | 3/1964 | Chordas | 273/93 |
| 3,222,068 | A | * | 12/1965 | Cowles, Jr. | 273/134 |
| 3,224,772 | A | * | 12/1965 | Wells et al. | 273/93 |
| 3,492,001 | A | * | 1/1970 | Coffey, Sr. | 273/141 |
| 3,972,530 | A | * | 8/1976 | Dohn | 273/88 |
| 4,210,335 | A | * | 7/1980 | Licciardi | 273/238 |
| 4,230,316 | A | * | 10/1980 | Harper | 273/93 R |
| 4,261,569 | A | | 4/1981 | Frohlich | |
| 4,634,125 | A | * | 1/1987 | Seklecki | 273/93 R |
| 4,687,199 | A | | 8/1987 | Aguirregomezcorta | |
| 4,708,344 | A | * | 11/1987 | Wyatt | 273/93 R |
| 4,735,415 | A | * | 4/1988 | Corn | 273/89 |
| 5,067,079 | A | * | 11/1991 | Smith, III et al. | 364/410 |
| 5,129,651 | A | * | 7/1992 | Tobias, Jr. | 273/93 R |
| 5,322,292 | A | | 6/1994 | Dileva et al. | |
| D353,408 | S | | 12/1994 | Springer | |
| 5,415,412 | A | * | 5/1995 | McMahon | 273/244 |
| 5,435,567 | A | | 7/1995 | Compres | |
| 5,540,440 | A | * | 7/1996 | Liu | 273/259 |
| 5,582,409 | A | | 12/1996 | Mayorga et al. | |
| 5,769,714 | A | | 6/1998 | Wiener et al. | |
| 5,884,914 | A | | 3/1999 | Lilien | |

* cited by examiner

*Primary Examiner*—Benjamin H. Layno
*Assistant Examiner*—D Collins
(74) *Attorney, Agent, or Firm*—Richard C. Litman

(57) ABSTRACT

A simulated baseball game uses conventional cubical dice to determine the outcome of each play. However, the specific rules and method of play of the present game provide an advantage to the player knowledgeable about the actual game of baseball, as that player is better able to judge various decision making points such as steal and hit and run attempts, taking pitches, etc. The present game thus provides an excellent teaching tool for a person learning the theory behind the actual game of baseball. The present game includes a playing field (tangible structure, or electronic video representation) representing an exemplary baseball stadium with its infield, outfield, bases and base paths, score and status boards, etc. The playing field is divided into a series of zones corresponding to the additive numbers achieved by tossing the two cubical dice to determine the simulated location of a ball in play. The zones are organized to simulate the higher likelihood of a ball being hit to the left side of the field, as actually occurs due to the higher percentage of right handed batters and tendency to "pull" the ball to the opposite field. The method of play for the present game provides for action by the pitcher, batter, and (if necessary) the defense by rolling the dice, with players making further decisions during play. Additional methods for stealing bases, tagging up, and hit and run plays are also disclosed for the present game. The game is also adaptable to wagering and casino play.

20 Claims, 9 Drawing Sheets

SIMULATED BASEBALL GAME AND METHOD

BACKGROUND OF THE INVENTION

1. Field of the Invention

The present invention relates generally to board and electronic games, and more specifically to such a game simulating the game of baseball. The present game is played using dice, or electronic random chance means providing the same odds, but an advantage is provided to players who know the game and utilize appropriate strategies during play.

2. Description of the Related Art

Innumerable active games and pastimes have been developed in the past, in the form of so-called "stick and ball" sports and others. Such games generally require that the players be fit, or at least interested in performing an athletic activity involving some exertion and effort. More sedentary games have also evolved over time, with such games generally involving either mental skills and expertise, or chance means for determining the outcome. Many of these sedentary games (board games, etc.) have attempted to simulate the strategy and action occurring in more athletic games (baseball, football, etc.), but it has proven to be difficult to create a sedentary game which includes sufficient realism to simulate a related athletic game accurately.

Accordingly, the present simulated baseball game and method provides an accurate simulation of the game of baseball, using only dice as the chance means for determining the outcome of various plays (pitches, batter actions and results, and defensive plays in the field). While at first glance the use of such chance means may appear to result in the outcome of the game being based upon pure chance, with more and less knowledgeable players having equal chances to win the game, it will be seen that a knowledge of baseball provides some advantage, in that the knowledgeable player is able to apply various tactics (e. g., steal, hit-and-run, etc.) in various situations as they may occur during the course of play. Also, the present game makes use of the greater or lesser probability of certain additive numerical combinations of dice to create greater or lesser likelihoods of certain occurrences during the course of play, as occur in an actual baseball game. The present game may be adapted to electronic and/or casino play, as well as play as a board game.

A discussion of the related art of which the present inventor is aware, and its differences and distinctions from the present invention, is provided below.

U.S. Pat. No. 4,261,569 issued on Apr. 14, 1981 to Stanley J. Frohlich, titled "Baseball Board Game," describes a simulated baseball game using dice, with further action being determined by the drawing of cards having descriptions of various player actions and statistics thereon. Most of the results of the Frohlich game are determined by a series of cards which describe various actions resulting from various numbers determined by the dice, rather than using the dice themselves to determine the action, as is done in the present simulated baseball game. Moreover, Frohlich uses only two different dice (different colors, etc.) tossed simultaneously to determine the actions of both the pitcher and batter, whereas the present game utilizes a first toss of two dice by the player representing the pitcher to determine the location of the pitch (strike or ball, etc.) and a subsequent toss by the batter to determine the outcome of the swing (if any). A further toss is made by the player acting as the defense to determine the outcome of the resulting fielding play, if any, with other dice tosses being used for various other circumstances (hit and run, etc.) The Frohlich game is limited in that it must utilize statistics provided from existing players, rather than determining player action by means of the dice. Moreover, the Frohlich playing field does not provide any input to the game insofar as the results of a simulated hit or fielding play are concerned. In contrast, the field of the present simulated baseball game is divided into zones corresponding to various totals which may be achieved by tossing the dice, and which provide some input as to the outcome of the game. While Frohlich states that one object of his game is to provide a very rapidly paced game which may be played in only ten to fifteen minutes, such a short time span leaves out innumerable possibilities which may occur during actual play, with the present game taking into account most such possible situations and strategies.

U.S. Pat. No. 4,687,199 issued on Aug. 18, 1987 to Enrique Aguirregomezcorta, titled "Base Ball Game," describes a simulated game in which most of the action occurs by means of dice tosses simulating the actions of the pitcher, rather than any resulting actions by the batter or defensive fielders. Aguirregomezcorta uses a random chance device having four colored areas to determine the area of the playing field in which the ball is played after being hit, with the playing field being divided into colored areas matching those of the random chance device. The present game divides the field numerically, according to various combinations which may occur using two conventional dice. Aguirregomezcorta uses a similar means to simulate the actions of an umpire, as well. Otherwise, most of the play is determined by means of drawing cards and proceeding according to the action described on the cards, as in the Frohlich game described immediately above.

U.S. Pat. No. 5,129,651 issued on Jul. 14, 1992 to Tomas T. Tobias, Jr., titled "Baseball Board Game And Method Of Play," describes a game using multiple pairs of cubical dice, with each pair comprising two dice of different colors. The Tobias, Jr. playing field is considerably more complex than that of the present game invention, in that Tobias, Jr. provides a series of nine subdivisions on a generally square grid, with each subdivision having a series of thirty six two digit numbers therein. Tobias does not include any single digit numbers in the play of his game, as he does not add the two dice together to provide a total between two and twelve, as is done with the present game. Rather, Tobias treats each number of each of the two dice separately in using them to determine a grid position on his board. The numbers on the Tobias, Jr. board are randomized, with an equal probability of any of the numbers being used for either side of the board, i.e., to the left or right side of second base. In contrast, the present game board is divided into sectors which are organized according to the different probabilities of various additive combinations occurring with the dice. For example, it is well known that the most likely additive number to occur with two cubical dice is seven, and accordingly, the present game designates the left short outfield area using the number seven. In an actual baseball game, it is more likely that a ball will be hit to this area than to any other, as most batters are right handed and will pull the ball somewhat to the left side of the field. The present game divides the infield and outfield further, using similar logic to provide realistic play according to various probabilities using additive numbers from the dice pair, which is not disclosed by Tobias, Jr. Moreover, Tobias, Jr. requires a separate table in order to arrive at the nine different general areas of his playing board, since no single number may be greater than six when the dice are not used additively. This complicates the Tobias, Jr. game relative to the present game, by adding a further step to play. In addition, Tobias, Jr. does not provide a realistic rendition of the playing field with its base paths and other features, which features are a part of the present simulated baseball game.

U.S. Pat. No. 5,322,292 issued on Jun. 21, 1994 to Steven G. Dileva et al., titled "Method Of Playing A Baseball Board Game," describes a board game relating to various financial aspects of professional baseball. No simulated play of an actual baseball game is provided by the Dileva et al. board game. Rather, the goal of the Dileva et al. game is to acquire a greater amount of simulated wealth than the other player (s). Advance during play is provided by randomly drawing from a series of cards, each of which has some instruction which must be followed. Dileva et al. do not provide any other form of chance means in their game.

U.S. Pat. No. 5,415,412 issued on May 16, 1995 to Brad J. McMahon, titled "Apparatus For Determining Batting And Base Stealing Outcomes In A Baseball Board Game," describes a simulated baseball game in which various dice configurations are used to determine various outcomes, with a spinner being used to determine further outcomes. McMahon has considered the actual odds of various events occurring as generated by Major League Baseball play over two seasons, and has adjusted the various probabilities occurring with his chance means, to reflect closely these various statistical probabilities. However, McMahon does not divide his simulated playing field to represent various areas of play, as provided by the present game. Moreover, McMahon does not provide any means of simulating pitching or fielding probabilities, as is done in the present game, but only uses the chance means to determine batter action. In contrast, the present game provides pitcher, batter, and defensive action by tossing the dice.

U.S. Pat. No. 5,435,567 issued on Jul. 25, 1995 to Hector J. Compres, titled "Baseball Board Game," describes a game more closely resembling the game of the '292 Dileva et al. U.S. Patent discussed further above, than the present simulated baseball game. Compres provides a series of player cards, with the object of the game being to first acquire all of the cards of a given team. Travel about the peripheral playing path of the board is provided, but no simulated play of an actual game of baseball, including pitching, hitting, fielding, and base running, is provided by Compres, as is provided in the present simulated baseball game.

U.S. Pat. No. 5,582,409 issued on Dec. 10, 1996 to Fernando Mayorga et al., titled "Baseball Board Game," describes a game board having a plurality of paths thereacross representing various paths a baseball might take in play, and various other components. Mayorga et al. include multicolored dice to determine the movement of playing pieces during play of their game. However, Mayorga et al. do not provide any disclosure of the rules or method of play of their game. Thus, it is not possible to determine from their disclosure if any action simulating the pitching, hitting, and/or fielding of a baseball is controlled by their multicolored dice or in some other manner, whereas the present disclosure specifically describes such rules and method of play for the present simulated baseball game. Moreover, Mayorga et al. do not disclose any division of their playing field or board corresponding to any additive numbers produced by the tossing of two dice, as provided by the present game.

U.S. Pat. No. 5,769,714 issued on Jun. 23, 1998 to Herbert Weiner et al., titled "Methods And Apparatus For Playing Baseball Gambling Games," describes a means of simulating a baseball game electronically, using a video display or other suitable means. Weiner et al. state that the probability of various outcomes of their electronic playing method is based upon actual probabilities occurring during actual major league play, but do not disclose any means of generating these probable outcomes, as is provided in the present game. Moreover, Weiner et al. do not disclose a simulated playing field having a series of divisions corresponding to likely play of a ball in those areas in an actual game, as provided by the present simulated baseball game.

U.S. Pat. No. 5,884,914 issued on Mar. 23, 1999 to Mitchell Lilien, titled "Indoor Baseball Board Game," describes a simulated baseball game in which players representing the pitcher and opposing batter both toss a pair of dice simultaneously. If the batter's total is higher than the pitcher's, a "batter action" card is drawn which describes further play (batter reaches base or is out due to some specific play, etc.). In contrast, the present game utilizes dice to determine all outcome. Moreover, Lilien does not divide his game board in any way to simulate the travel of the ball to those areas, as is accomplished in the game board of the present game. The specific layout or pattern of the present game board, in cooperation with the known odds produced by the additive numbers of a pair of dice, provides realistic play which is not achieved in the same manner (if at all) in the Lilien game.

Finally, U.S. Pat. No. D-353,408 issued on Dec. 13, 1994 to John C. Springer, titled "Dice Baseball Game Board," illustrates a design for such a board. No method of playing the game, or other means (dice, player position or status markers, etc.) is disclosed in the Springer design patent, whereas such features are provided as a part of the present game. Moreover, Springer does not disclose any divisions of his game board to provide for the simulated play of the ball to those areas, nor any scoreboard means for keeping track of the score and status of the game, as provided by the present game board.

None of the above inventions and patents, taken either singly or in combination, is seen to describe the instant invention as claimed.

SUMMARY OF THE INVENTION

The present invention comprises a simulated baseball game for play by two opposing players (or teams of players). The present game includes means for simulating most of the outcomes made possible according to the rules, strategy, and tactics of the game of baseball, by means of conventional cubical dice and the novel playing field and rules of the present game. The present game may be played as a board game, using a game board resembling a baseball playing field or stadium with scoreboard, etc., or may be developed as an electronic game for play using a hand held or stationary video terminal or the like. The present game is also well adapted for play as a gambling game, due to the chance means involved.

The present game includes a game board (or electronic video representation) resembling a baseball field, but divided into a series of infield and outfield zones corresponding to the additive numbers produced by a pair of conventional cubical dice. These zones indicate the general locations of balls in play during the game, with the zones being weighted to provide somewhat higher odds of play to the left side of the field, as actually occurs due to the greater numbers of right handed batters and the natural tendency to "pull" the ball to the opposite field when hit. The game board also includes a scoreboard for keeping track of the score, as well as means for tracking the status of the game (outs, balls and strikes, etc.) during the course of play.

Play is accomplished generally in three steps, with the player acting as pitcher tossing the dice to determine the outcome of a pitch, the batter then tossing the dice to determine the result of the interaction between batter and pitched ball, and the defense tossing the dice to determine the outcome of a ball hit by the batter (if such occurs). Additional apparatus in the form of simulated base runners and pegs for tracking the score and status are also provided with the present game.

The rules or method of play of the present game provide realistic odds of the common occurrences in the game of baseball, such as balls and strikes, hits, strikeouts, and outs in play, and various baserunning tactics (steals, hit and run, etc.), all using conventional dice and the strategy of the players to determine these outcomes. While chance is involved in the present game, the player who is knowledgeable about the strategy and tactics of the game of baseball will possess a distinct advantage over other players, by having a better "feel" for situations in which taking a pitch, stealing a base, initiating a hit and run play, etc. may be involved.

Accordingly, it is a principal object of the invention to provide an improved simulated baseball game having a game board formed either as a tangible structure or as an electronic representation, resembling a baseball playing field and including a plurality of zones corresponding to the additive numbers achieved by tossing a pair of conventional cubical dice.

It is another object of the invention to provide an improved simulated baseball game which game board zones are placed to provide realistic location and play during simulated play, in accordance with actual play by actual left and right handed players.

It is a further object of the invention to provide an improved simulated baseball game which game board includes scorekeeping and status keeping means resembling the scoreboard at an exemplary baseball stadium.

An additional object of the invention is to provide an improved simulated baseball game which rules and method of play utilize random chance means to determine the outcome of each specific action, but which actions are influenced by the knowledge and experience of players with the actual game of baseball.

Still another object of the invention is to provide an improved simulated baseball game which lends itself to electronic play by means of hand held and arcade video game machines, as well as to wagering or casino games with participating and spectating players wagering upon the outcome of various plays and the game.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
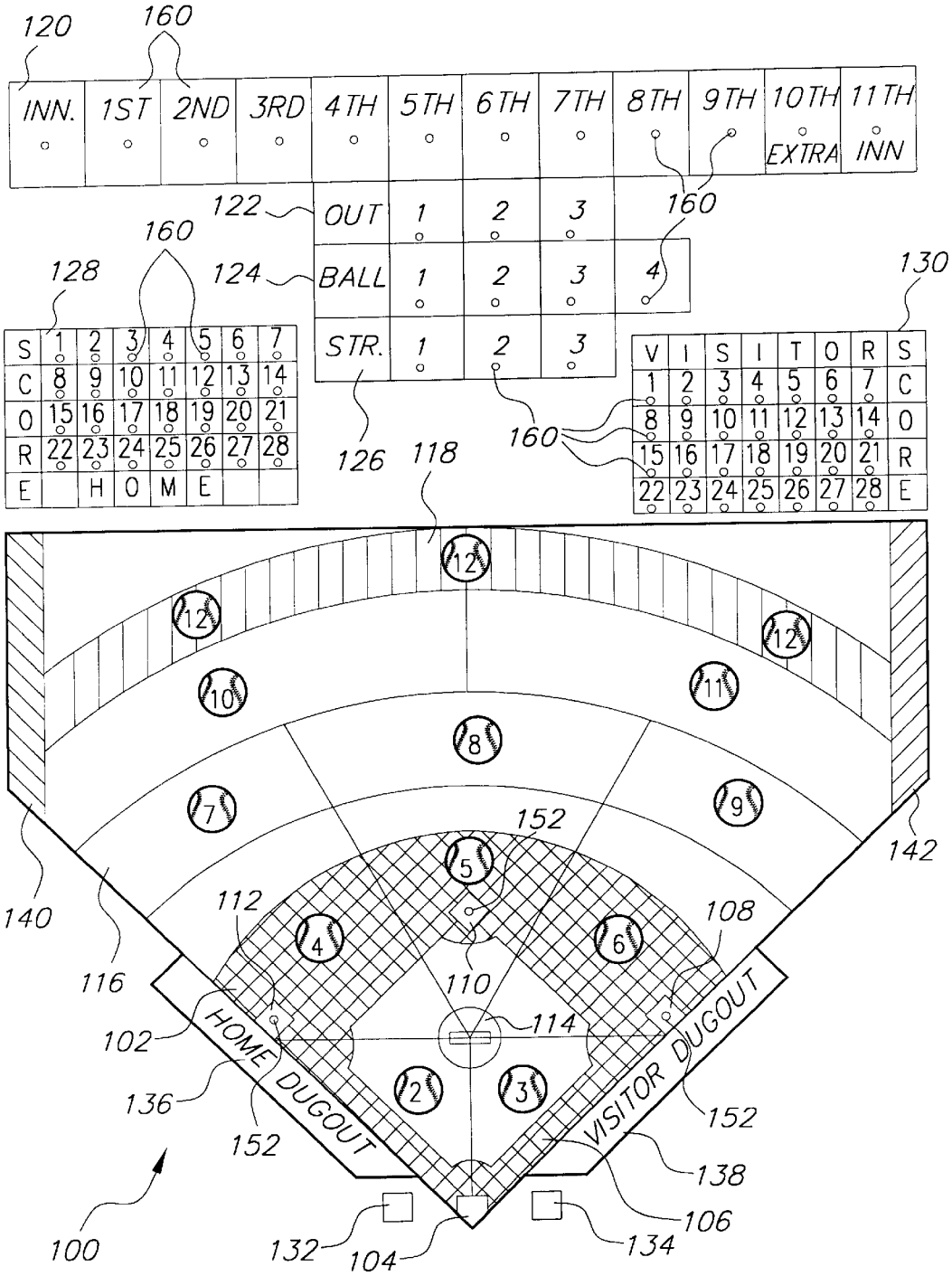
FIG. 1 is a plan view of the game board of the present simulated baseball game, showing its various features.

The present invention comprises a simulated baseball game apparatus, and a method of playing a simulated baseball game using the present apparatus as well. FIG. 1 illustrates an exemplary playing area 100 for play of the present game. While the playing area 100 is generally referred to as a game board throughout the present disclosure, it should be understood that the general term "playing area" encompasses such a physical game board structure, as well as electronic video representations of such a playing area. The present game is well adapted for play using either physical apparatus (game board, position markers and chance means, etc.) or by electronic devices (hand held or arcade type games, etc.). The present game also lends itself well to wagering and casino play, with both participating and spectating players being able to wager on the outcome of individual plays and the entire game as desired.

The playing field or game board 100 of FIG. 1 resembles an exemplary baseball park or field, with critical features required being shown on the board 100. The game board 100 includes an infield area 102 having a representation of home plate 104, a base path 106 with first, second, and third bases, respectively 108, 110, and 112, and a pitcher's mound and rubber 114. An outfield area 116 extends beyond the infield 102, with an outfield wall 118 depicted at the outer limit of the outfield 116. A scoreboard and status board may include a series of positions 120 for indicating the inning of the simulated game, other areas 122, 124, and 126 respectively indicating the number of outs and the ball and strike count upon the simulated hitter, and a home and visitors scoreboard area, respectively 128 and 130, for indicating those respective scores during the play of the game. Other areas may be depicted or provided as well, such as left and right batter's boxes 132 and 134, home and visitor's dugouts 136 and 138, left and right foul poles 140 and 142, etc. as desired for appropriate realism.

Figure 4:
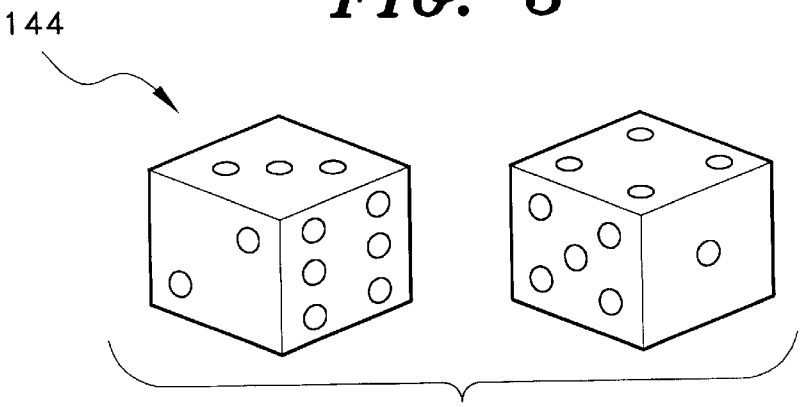
FIG. 4 is a perspective view of an exemplary pair of conventional cubical dice for providing the random chance means for various situations in the present game.

The infield and outfield areas 102 and 116 and wall 118 are divided into eleven zones 2 through 12, corresponding to numbers provided by a pair of conventional cubical dice 144 (FIG. 4) by adding the two numbers of the dice. (Electronic means duplicating the probabilities provided by the dice may be used alternatively.) These zones, indicated by the baseball symbols in the infield 102, outfield 116, and wall 118, are placed according to the probability of their respective additive numbers coming up on the dice 144, and corresponding to the likelihood of a ball in play in each zone.

Conventional cubical dice provide a relatively low probability (1 in 36, or about 2.78%) of rolling either the lowest (2) or highest (12) numbers possible, with the various permutations and combinations increasing in a "bell curve" like probability curve so that an additive total of 7 is the most likely number to be rolled, with a probability of 6 in 36, or about 16.67%. These probabilities are well known, and the present game makes use of these various probabilities in the layout of the separate zones 2 through 12 on the playing field or game board 10.

In baseball, most hits (or more accurately, a contact swing, in which the bat makes contact with the ball to send the ball into the playing area) are driven to the infield and short outfield areas of play. Relatively few contacts are so weak as to remain within the area between the pitcher's mound and home plate, and many of those that are, are intentional bunts. Also, relatively few balls are hit so hard that they clear the wall or fence defining the outer limit of the outfield. The configuration of the present playing area 10, with its zones 2 through 12 dividing that area, provides a realistic representation of these probabilities. It will be seen that zones 2 and 3, representing the relatively low probabilities of dice tosses totaling 2 and 3, are positioned in the short infield area between home plate 104 and the pitcher's mound 114. It is increasingly probable that the dice will total a higher number, such as 4, 5, or 6, and accordingly, these numbers are distributed through the infield to short outfield areas, where most balls will be hit during the course of play in an actual game.

The number 7 is the most likely number to be rolled using a pair of conventional cubical dice, as noted further above, with the numbers 8 and 9 having probabilities equal to the numbers 5 and 6. The slightly higher probability of rolling the additive total from 7 to 9 inclusive, as opposed to the numbers 4 through 6 inclusive, is realistically represented on the playing field 10 by placing zones 7 through 9 respectively in the left, center, and right areas of the outfield 116. Finally, the odds of rolling double sixes for a total of twelve are the same as those of rolling double ones for a total of two. The relatively small odds (about 2.78%, as noted further above) correspond closely with the actual odds of a batter hitting a home run in an actual baseball game.

Moreover, it will be noted that zone 7 is placed to the left side of the short outfield area, with zones 8 and 9 being placed respectively to the center and right short outfield areas. This is intentional, as most batters are right handed. It is also well known in baseball, that most hitters will tend to "pull" the ball, i. e., hit the ball to same the side of the field as that of the batter's box which they use. In other words, a right handed batter would stand to the left side of home plate 104, in the left side batter's box 132, and would be somewhat more likely to "pull" the ball to the left short infield zone 7 than to the other short infield zones 8 and 9 when hitting. Left handed batters, being in the minority, also tend to "pull" the ball when hit, but such a hit will tend toward the short center or right field zones 8 and 9, with their somewhat lower probability of coming up on the dice.

Thus, it will be seen that the zones 2 through 12 of the playing area 100, and their arrangement from the short infield 102 to the outfield wall 118 and from left to right fields, provide realistic probabilities of a simulated hit to a corresponding one of the zones. The use of conventional cubical dice, along with the specific arrangement of the zones 2 through 12 on the playing area 10, provide such realism within a few percent of the probabilities to be actually encountered in an actual baseball game, thus providing the present simulated game with very accurate realism using only a pair of dice (or electronic random generator means providing probabilities corresponding to those provided by dice), rather than requiring additional equipment.

Figure 2:
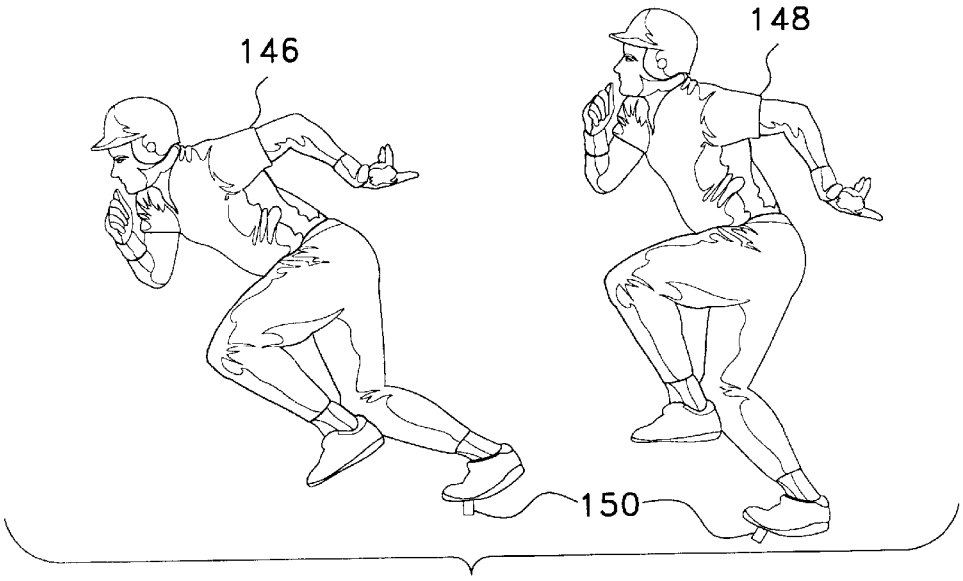
FIG. 2 is an elevation view of a pair of player position markers resembling base runners, for indicating the positions of such offensive players during the course of play.

FIG. 2 illustrates two exemplary player position markers, respectively 146 and 148, for use in the play of the present game to mark the positions of simulated base runners along the base path 106 of the field 100. Preferably, a series of several such markers 146 and 148 is provided for each player or team (home and visitor), with the two types of markers 146 and 148 being distinguished from one another in some manner (e. g., the darker shading or stippling of the second marker 148, etc.) in order to identify the respective team or simulated baseball game player to which they belong. Each marker 146 and 148 is preferably configured to look like a base runner in a baseball game, and includes a pin or peg 150 extending from the lower portion thereof. These pins 150 are inserted into a corresponding socket 152 in a base 108 through 112 of the playing area 100, to indicate any simulated players on base.

Figure 3:
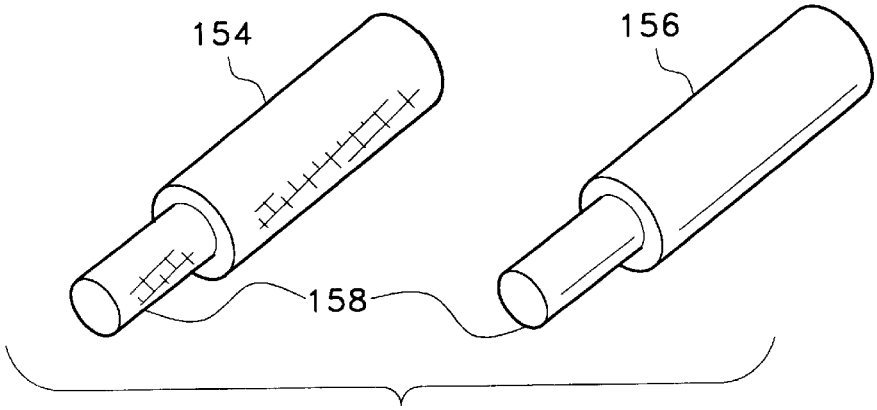
FIG. 3 is a perspective view of a pair of pegs used for tracking the score and status of the present game.

FIG. 3 illustrates exemplary first and second status and score markers or indicators, respectively 154 and 156, for removable installation in the scoreboard and status board areas 120 through 130 of the playing field or board 100. As in the manner of the player position markers 146 and 148, these score and status indicators 154 and 156 may be shaded somewhat differently from one another in order to make clear which team or "side" is at bat or on offense at any given point in the game. The indicators 154 and 156 may also include pins or pegs 158 extending therefrom, for removable insertion into corresponding sockets 160 formed in appropriate areas of the status and scoreboards 120 through 130. It will be seen that additional status indicators and corresponding sockets 160 (not shown) may be provided as desired to show additional status points of the game, e. g., top or bottom of the inning, etc. In a like manner, additional sockets 152 (not shown) may be provided along the base path 106 for players to indicate a long lead, as in a steal or hit and run attempt, or for other areas of the field 100, such as the infield and outfield zones 4 through 11, etc., as desired.

Figure 5A:
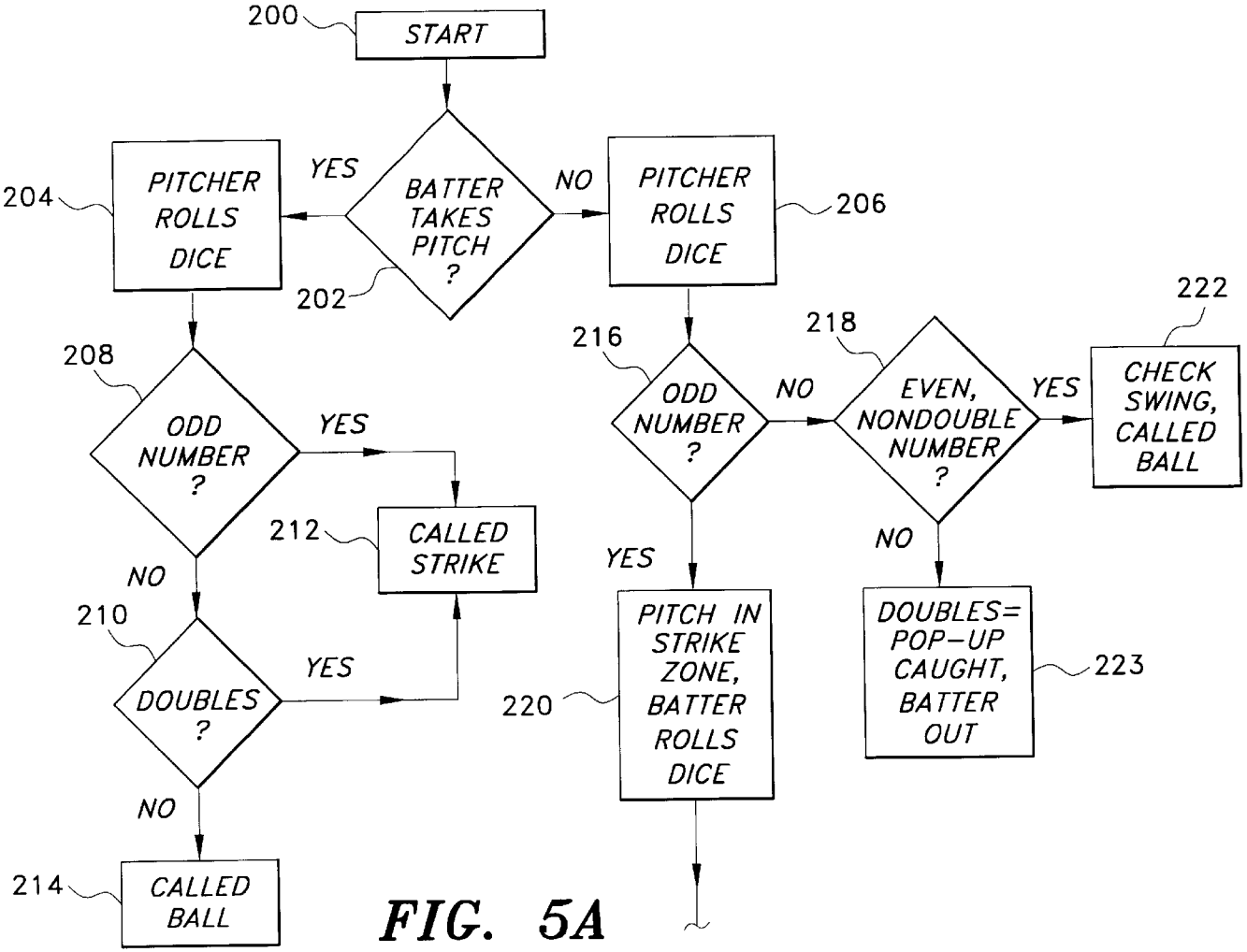
FIGS. 5A and 5B are first and second portions of a flow chart disclosing the basic steps in the method of play of the present game.

FIGS. 5A through 8B provide flow charts of the method of play of the present simulated baseball game and various aspects thereof. FIGS. 5A and 5B show the basic steps involved in a simulated at bat for the offense and defense, with the simulated stealing of a base being shown in FIG. 6, a runner or runners on base tagging up in FIG. 7, and the steps involved in a hit and run play in FIGS. 8A and 8B.

The present simulated baseball game is begun by setting up the playing area 100 as described above, with appropriate numbers of player position markers 146 and 148 and score and status indicators 154 and 156. At least one pair of cubical dice 144 is provided for the chance means of the present game, with two pair (one for each of the two players or teams of the present game) preferably being provided in order to avoid the need for transferring the dice 144 back and forth between the players. As noted further above, the playing area 100 may be provided as an electronic representation for electronic play, with the player position markers 146 and 148 and status and score indicators 154 and 156 also being rendered electronically for a video display. The chance means may comprise a random number generator subroutine providing randomly generated numbers from two through twelve with the same odds as provided by the additive numbers of a pair of dice. The two players (or teams of players, if more than two players are involved) determine which is to represent the home team, and which will represent the visiting team, as in an actual game of baseball. These various aspects of setting up the present game may be considered to be a part of the first or "start" step 200 of FIG. 5A.

When the above beginning aspects of the game have been determined, the player acting as or for the visiting team determines whether he or she will "take" or "swing" at the first pitch, as indicated by the second step 202 of FIG. 5A. This is done before any simulated pitch occurs, and is done before each pitch of the game.

In either case, the player acting as pitcher (defense) then tosses his or her dice (or actuates the random number generator) to determine the success of the simulated pitch, as indicated by the mirror image third and fourth steps 204 and 206 (the same action by the pitcher, but with different results depending upon whether the batter is taking or swinging at the pitch). In the event that the batter is taking the pitch and the dice roll of step 204 results in an odd number (3, 5, 7, 9, 11) as indicated by the fifth step 208, or any doubles (two ones, twos, threes, etc.), as indicated by the sixth step 210, then the pitch is considered a called strike, as indicated by step 212 (i.e., in the strike zone, and the batter did not swing, as indicated by the "Yes" side of the "Batter Takes Pitch" second step 202 of FIG. 5A). The probability of this event is 24/36, or about 66.67%.

The remaining alternative dice roll resulting in even numbers (but not counting doubles) is somewhat less likely, having a probability of 12/36, or about 33.33%. In this event, the pitch is considered to be out of the strike zone, resulting in a called ball, as indicated by the ninth step 214 of FIG. 5A. Thus, it is about twice as likely that a pitch will be a strike than a ball when the batter is taking a pitch in accordance with the present game rules. This is quite realistic, in that typically a pitcher throws more strikes than balls, and the likelihood is that a batter who takes every pitch will be called out on strikes. The above procedure, with the batter deciding to take or swing and the pitcher rolling the dice, is repeated for each simulated pitch.

In the event that the batter decides to swing at the pitch, the pitcher rolls the dice once again, as indicated by the fourth step 206 of FIG. 5A. However, in this case, the odds are adjusted to allow for the batter frequently making contact with the ball. Accordingly, an odd number (18/36 chance) or doubles (6/36 chance) is considered in the strike zone, as indicated by the steps 216, 220, and 223 of FIG. 5A. The total odds of this occurrence in the present game are 24/36, or about 66.67%. (A special case occurs when the batter rolls the same odd number as rolled by the pitcher, in which case it is considered a swinging strike.)

If an even, non-double number is rolled by the pitcher (i. e., a ball outside the strike zone), which will occur about 33.33% of the time, the event is considered a check swing by the batter and a called ball, as indicated by step 222 of FIG. 5A. Finally, the tossing of doubles (e. g., two fours, two threes, etc.) by the pitcher is considered to result in a "pop-up," in which the batter swings and makes contact, but the ball is hit as a relatively short fly ball (either fair or foul), and is caught by a defensive player for an out. This is indicated by step 223 of FIG. 5A.

Play begins again by the batter determining whether or not to take or swing at the next pitch, according to step 202, assuming the batter has not reached base or been called out in accordance with the conventional rules of baseball. This again is in keeping with actual baseball, in which swinging hitters will most often contact the ball.

However, contact does not guarantee a hit, as other factors (fair or foul ball, fielding, etc.) come into play as well. Assuming the dice (or other corresponding electronic chance means) have determined that the batter swung at a pitch in the strike zone, as indicated by step 220 of FIG. 5A, then the offensive player (batter) must roll the dice to determine the next portion of the outcome of the play, as indicated in the step 220 of FIG. 5A. Depending upon the outcome of this batter's roll of the dice and subsequent roll of the dice by the fielding or defensive player, the result may be considered a hit or an out, as described below.

Figure 5B:
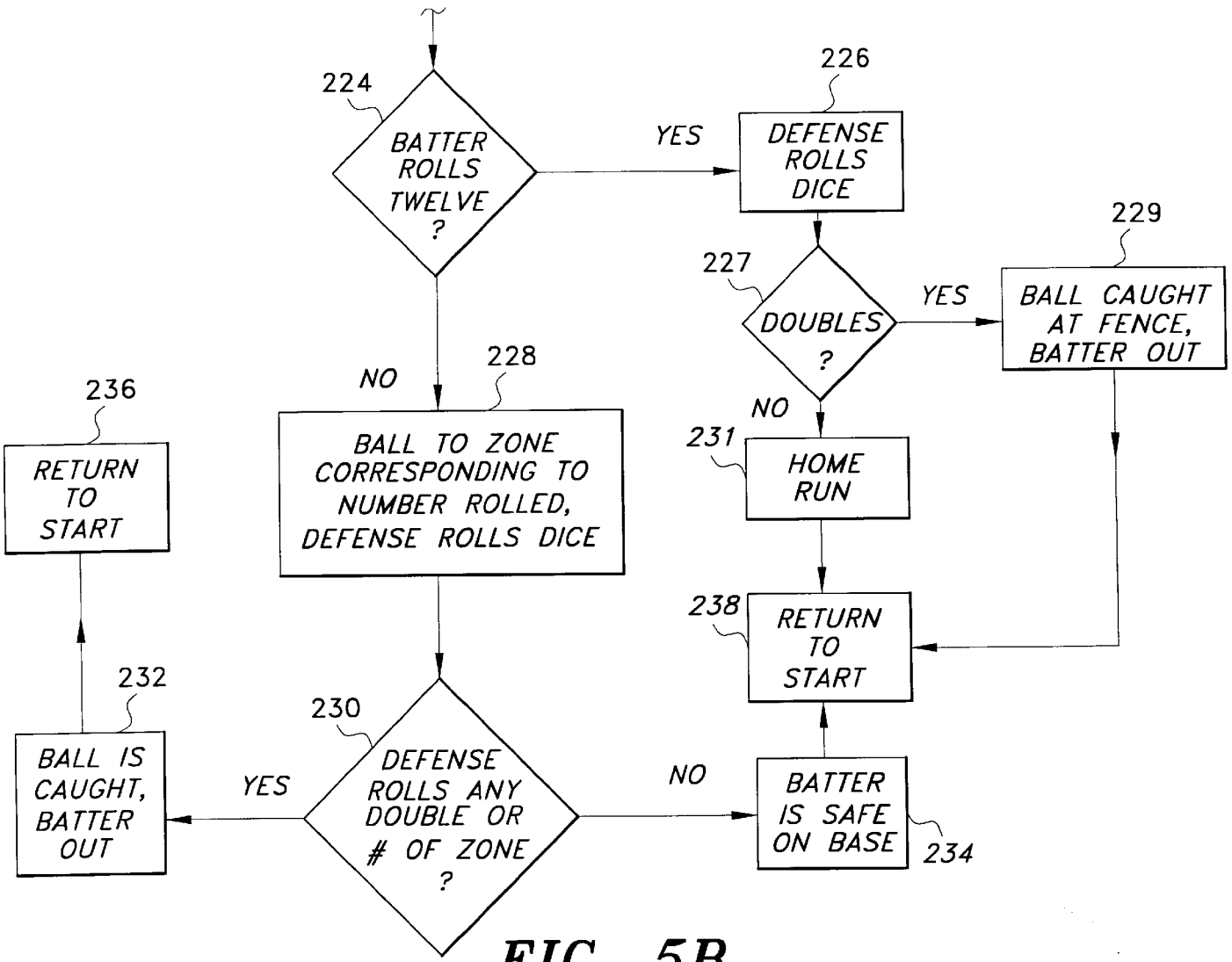

Once the batter has rolled the dice according to step 220 of FIG. 5A, the results of that roll must be considered, as shown in FIG. 5B. Essentially, the additive count of the dice define the zone to which the ball is considered to have been hit, generally as indicated by step 228 of FIG. 5B. Thus, a roll of two by the batter would result in the ball being hit to zone 2 of the field 100, or a "dribbler" or "bunt" to the left side of the pitcher's mound. A roll of seven would result in a simulated drive to middle range left field, the most likely occurrence. Longer drives (zones 10 and 11) are considered multiple base hits. Doubles tossed by the batter are considered as "line drives" along the left or right field lines, with double twos and threes counted as two base hits and double fours and fives counting as three base hits along the respective left and right field lines. A roll of double sixes (twelve) indicates that the ball has been driven to zone 12 of the field 100 of FIG. 1, to or over the outfield wall or fence 118.

Whenever the offensive player (batter) makes contact with the ball (other than the "pop-up" scenario, when the pitcher tosses doubles and the batter is simulating a swing), the defensive player or fielder must toss the dice in response, to determine the outcome of the play. During the time between the batter's roll of the dice and the defending player's roll of the dice, the simulated baseball may be considered to be "in the air" or "rolling on the ground," in play before being handled by a defensive player or fielder. The defense must achieve one of two different outcomes with the dice, in order for the batter to be considered out after a non-popup contact with the ball: Either the defense must roll doubles (a 6/36 chance), or must roll an additive number equal to the zone to which the ball has been driven by the batter. Thus, the probability of the ball being considered a hit by the batter, depends upon the zone to which the ball is hit. As an example, a ball hit to zone 7, provides the defensive team with more chances of rolling a like number with the dice (6/36) than a ball hit to zone 11 (a 2/36 chance). This is in keeping with actual baseball play, in that routine drives to the middle outfield are most likely to be caught for an out. The above possibilities are indicated generally by steps 228 through 232 of FIG. 5B, with play then returning to the starting sequence of FIG. 5A, as indicated by the step 236 of FIG. 5B. Any other defensive roll is considered to be a hit by the batter, with the batter being safe on base, as indicated by step 234 of FIG. 5B, with play again resuming at the start in FIG. 5A.

A special situation occurs when the batter rolls double sixes, or twelve, as indicated by step 224 of FIG. 5B. Normally, this would be considered a home run, with the batter and any runners on base, scoring. However, the defense still has one chance to put the batter out in this situation. As in the above described examples where the defense rolled doubles, or a number equal to the zone to which the ball was hit, in order to put the batter out, the same applies for a potential home run ball, as indicated by step 226 of FIG. 5B. It will be seen that the zone to which the ball is hit, and the doubles possibility, are one and the same number for a ball hit to zone 12: The defense must also roll double sixes, a 1/36 chance, or about 2.78%, as shown in step 227. If the defense does manage to achieve such a roll, it is considered as an outfielder leaping with his glove extended above the top of the outfield wall to make a leaping catch, essentially "robbing" the batter of a home run—one of the most spectacular, and unusual, plays in baseball, and represented by the step 229 of FIG. 5A. Any other roll by the defense after double sixes by the batter is considered as a home run, as indicated by step 231 of FIG. 5A, with play returning to the starting point of FIG. 5A, as indicated by step 238 of FIG. 5B.

Figure 6:
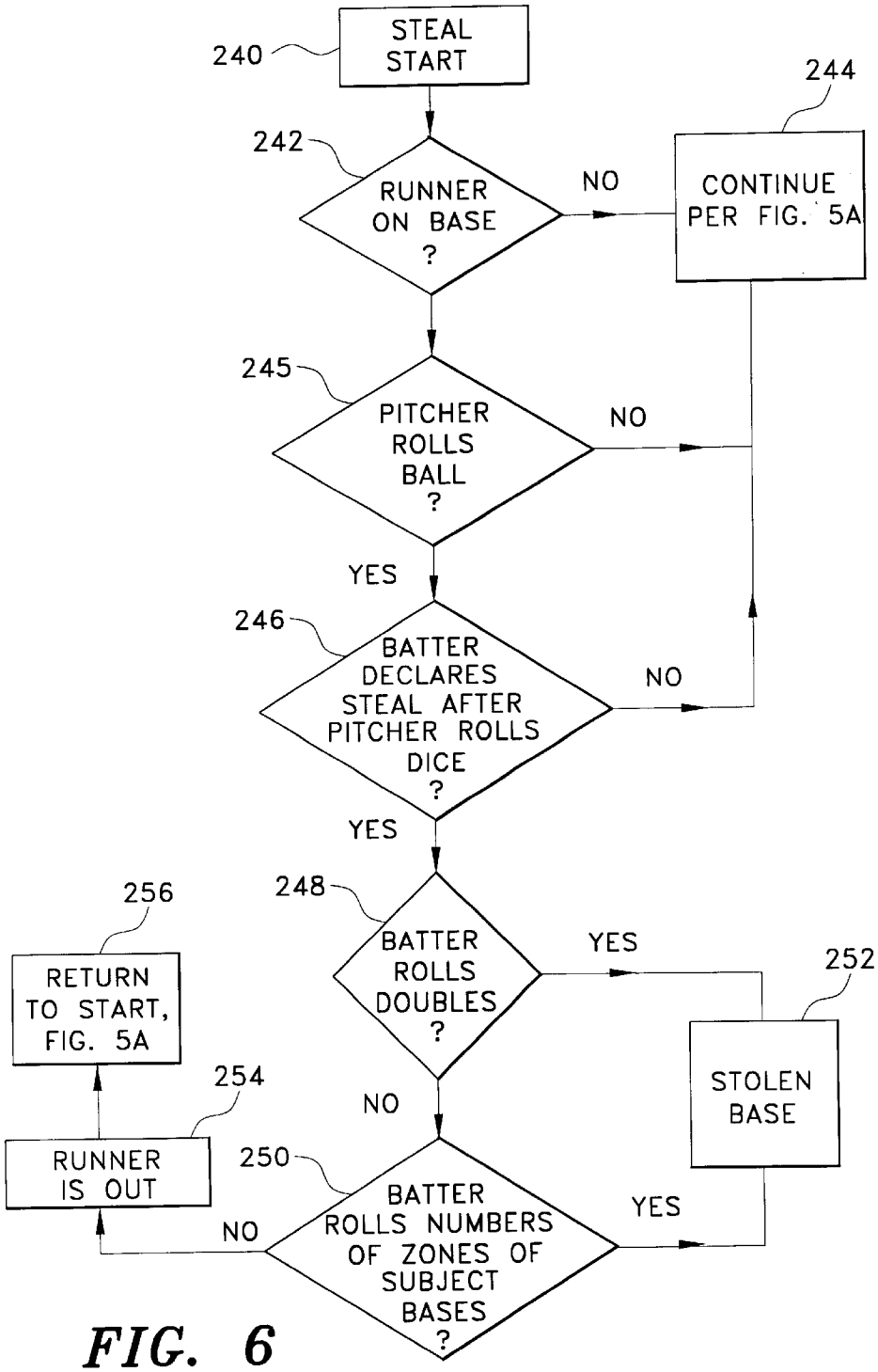
FIG. 6 is a flow chart disclosing the basic steps involved in the stealing of a base by a base runner in the present game.

FIG. 6 is a flow chart illustrating the general steps involved in simulating an attempted (or successful) steal according to the present simulated baseball game. From the beginning position 240 of FIG. 6, it must first be determined that at least one runner is on base, as indicated by the second step 242 of FIG. 6. Obviously, if no runner(s) is/are on base, then no base stealing attempt may be made, and play returns to FIG. 5A, as indicated by the third step 244 of FIG. 6. However, if at least one base runner is on base, then the batter or offensive player may declare a steal attempt after the pitch. A steal attempt may only be declared by the batter if the pitcher rolls an even, non-doubles number with the dice, corresponding to a ball out of the strike zone, as indicated by step 245 of FIG. 6; hence, the need for the batter player to wait until the pitching player tosses the dice in order to determine the disposition of the pitch. This rule has the effect of limiting the number of steals which may be attempted during the course of play, and maximizes the interaction between pitcher and batter players.

A successful simulated steal is determined by the offensive player rolling the dice after the pitcher's (defensive player) dice roll. If the offense rolls either doubles (a 6/36 chance) or a total equal to the two zone numbers of the subject bases (a 2/36 chance), as indicated respectively in the fifth and sixth steps 248 and 250 of FIG. 6, then the steal attempt is considered successful, as indicated by the seventh step 252 of FIG. 6. Any other number results in the base stealing runner being considered out, as indicated by the eighth step 254, with play returning to the start step 200 of FIG. 5A after the attempt, as indicated by step 256 of FIG. 6. As an example of a successful non-doubles roll for a simulated base runner on first base (zone 6 in FIG. 1) who is attempting to steal second base (zone 5), the player would have to roll a six and a five (or doubles, as noted above) with the two dice to indicate a successful steal. If the simulated runner were on second base (zone 5) and attempting to steal third base (zone 4), the player must roll a five and a four (or doubles) for a successful steal, with the odds being 8/36, or about 22.22%.

Figure 7A:
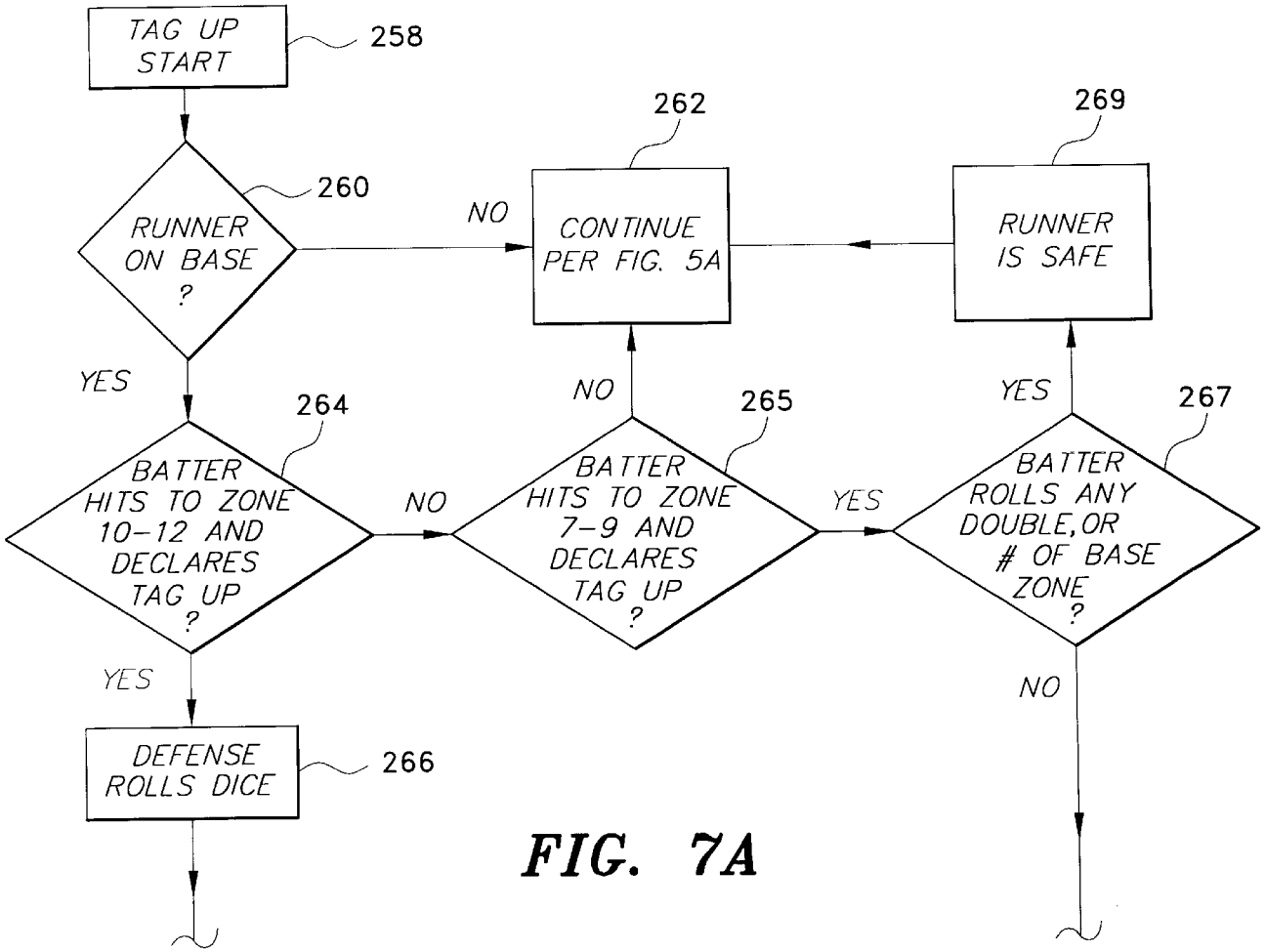
FIGS. 7A and 7B are first and second portions of a flow chart disclosing the basic steps involved in a base runner tagging up during the play of the present game.
Figure 7B:
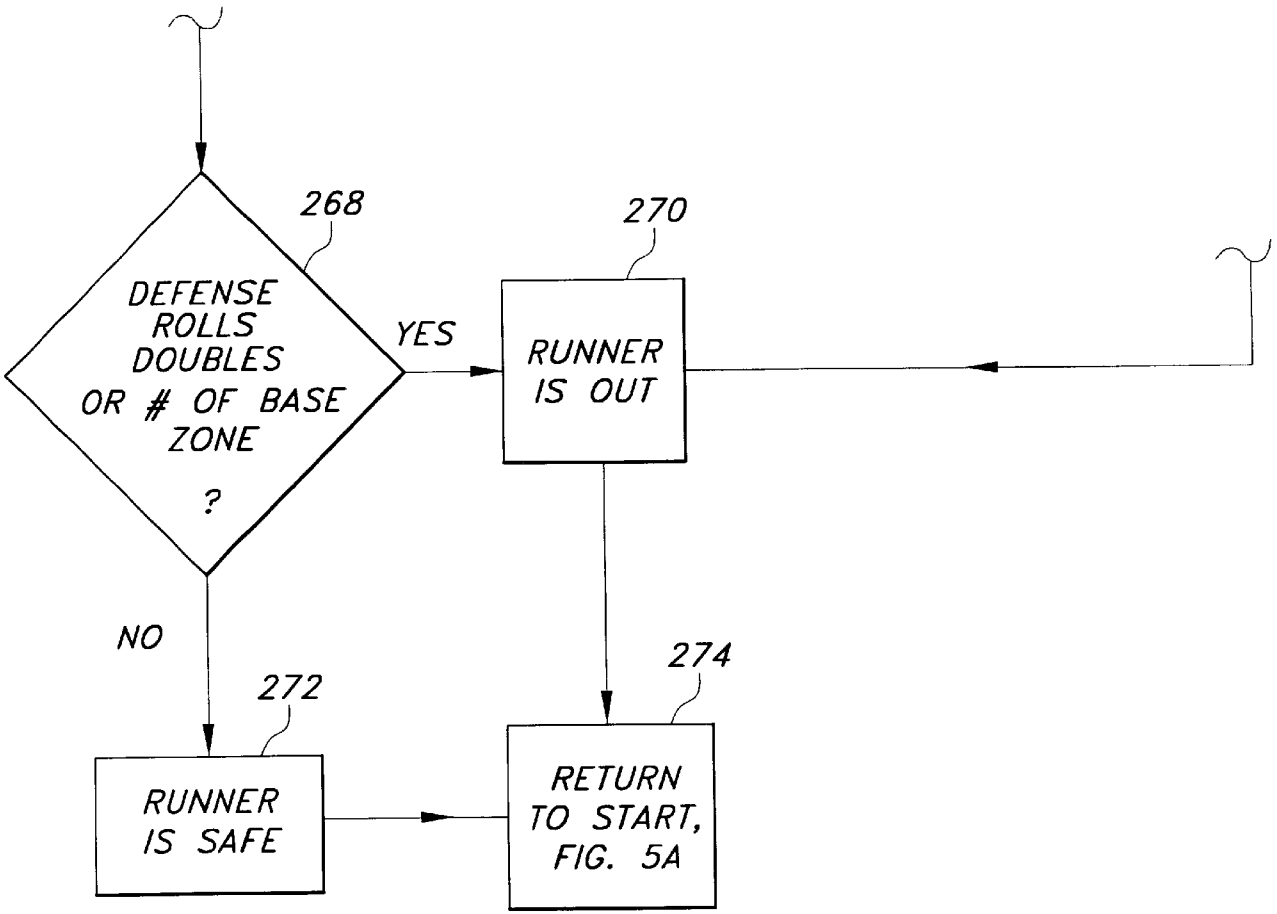

FIGS. 7A and 7B disclose the basic steps involved in the simulation of a "tag up" play in accordance with the present simulated baseball game. The "tag up" play is intended to advance a baserunner even though the batter may be out due to a long fly ball being caught in the outfield. Conventional baseball rules permit the baserunner to hold his/her position on the base, and leave the base when the ball is caught. At this point, it becomes a race between the baserunner attempting to reach the next base (or home plate from third base) and the ball being thrown in from the outfield after the catch. Accordingly, the second step 260 after the first "Tag Up Start" step of FIG. 7, is to determine whether or not there is/are a runner or runners on base, just as in the second step 242 of the base stealing procedure of FIG. 6, described above. If there are no base runners, then the tag up method is not applicable, and play returns to FIG. 5A, as indicated by the third step 262 of FIG. 7A.

However, if there is at least one simulated base runner on second or third base (a successful tag up from first to second base is unlikely in actual play, and thus is not considered in the present simulation), the offensive team (batter) has the option of declaring "tag up" after rolling the dice to provide an additive total of ten through 12, in accordance with the fourth step 264 of FIG. 7A, indicating a simulated long ball hit to any of the zones 10 through 12 of the playing field 100 of FIG. 1. (A roll of double sixes or twelve would represent a ball hit to the wall, with the possibility of a simulated catch at the top of the fence if the defense also rolls twelve on their defensive play, in accordance with steps 227 and 229 of FIG. 5B. Hence, a roll of twelve by the batting player must also be considered in the tag up scenario.)

At this point, the defensive side (fielding) rolls the dice to determine the outcome of the play, in keeping with the fifth step 266 of FIG. 7A. If the defense rolls any doubles or the number of the base zone to which the runner is advancing (e. g., a four, for a runner advancing from second to third), as indicated by the first step 268 of FIG. 7B, then the runner advancing from second to third (zone 4 of the FIG. 1 playing field 100) is considered to be out, as indicated by the second step 270 of FIG. 7B, with any runner advancing from third to home considered as safe and scoring a run. (The defense must roll only doubles for the runner to be considered out at the plate, or zone 2.) This is in keeping with actual play, as home plate is considerably farther from the outfielder making the throw in, and thus a runner on third has more time to reach home plate, than a runner advancing from second has time to reach third. Any other roll by the defense results in the second (and third) base runner(s) being considered safe, as indicated by the third step 272 of FIG. 7B. Play then returns to the sequence of FIG. 5A, as indicated by step 274 of FIG. 7B.

It will be seen that a successful tag up play may be possible from a shorter hit ball in some instances, although it is not so likely as with a long ball to the deep outfield or to the fence (zones 10 through 12 of the field 100 of FIG. 1). Accordingly, the present simulated baseball game also provides for a tag up possibility when a ball is hit to zones 7 through 9, or the middle distance outfield, as well, as indicated by step 265 of FIG. 7A.

The basic rule for determining the success of the tag up for a shorter hit ball is essentially opposite that for tag up plays resulting from longer balls to the deep outfield or fence. In the case of shorter balls to zones 7 through 9, the batter must roll the dice again, and must roll either doubles or the number of the base zone to which the tagging baserunner is advancing, as indicated by step 267 of FIG. 7A. The odds of this occurring are 6/36 (for any doubles) plus the odds of the zone number of the base (either two or four, for home plate and third base, respectively) Thus, the odds will vary between about 16.67% and 25.00% that the tagging up runner will be considered safe with a shorter hit ball to zones 7 through 9, but the same relatively low odds exist that the runner will be out for balls hit to the deep outfield and fence zones of 10 through 12. If the player is successful in rolling doubles or the numbers of the zones of the bases according to step 267, then the runner is considered safe, as indicated by step 269 of FIG. 7A. Otherwise, the runner is considered out, as shown in step 270 of FIG. 7B. Play then returns to FIG. 5A as indicated by steps 262 and 274, respectively of FIGS. 7A and 7B.

Figure 8A:
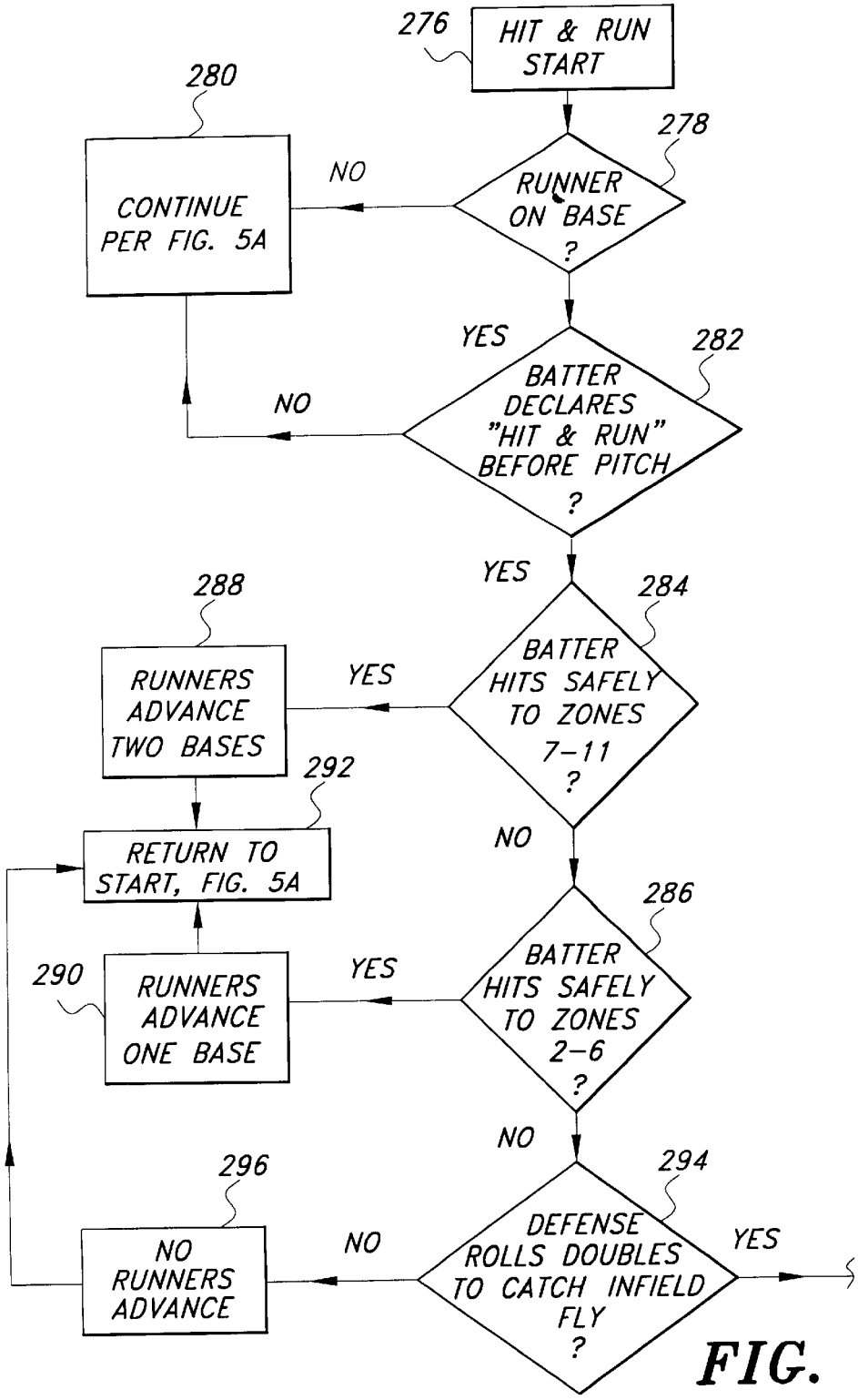
FIGS. 8A and 8B are first and second portions of a flow chart disclosing the basic steps involved in a hit and run play in the present game.
Figure 8B:
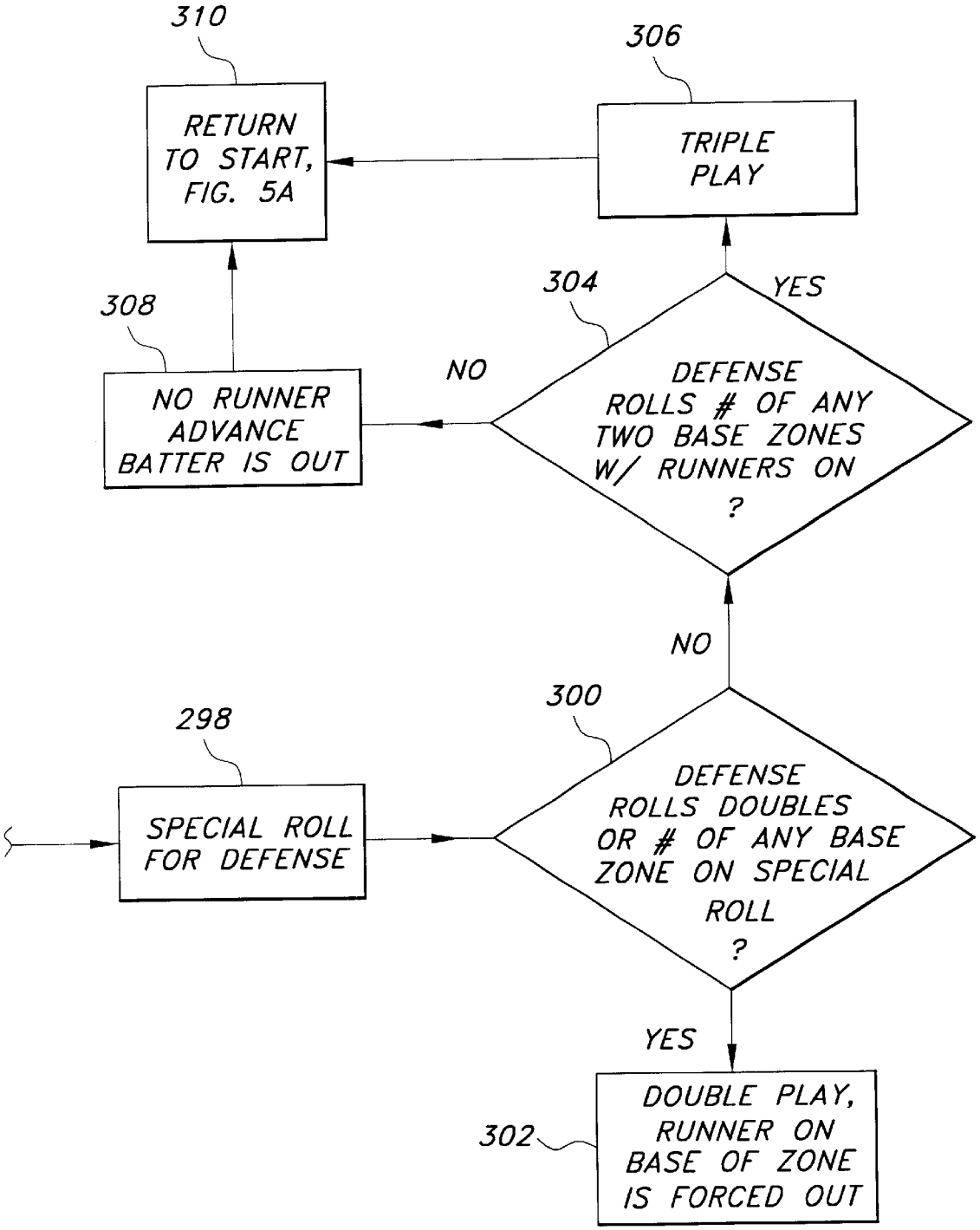

FIGS. 8A and 8B describe the basic steps and sequence of play in a hit and run play according to the present simulated baseball game. In a hit and run play, the runners attempt to take advantage of any ball which may be hit by the batter to gain as many bases as possible on the play. In the actual game of baseball, an alert runner on a successfully executed hit and run play may advance from first to third base on an otherwise conventional single base hit by the batter. The present game simulates this play in accordance with the steps of FIGS. 8A and 8B.

As in the base stealing and tagging up procedures respectively of FIGS. 6 and 7A/7B, at least one runner must be on base for a hit and run play. Thus, the next step 278 following the start step 276 of FIG. 8A determines whether there is a runner on base or not. If not, then the game continues by returning to the steps of FIG. 5A, as indicated by the third step 280 of FIG. 8A. If at least one runner is on base, then the offense (batter) may declare a "hit and run" before the dice roll by the player acting as pitcher, as indicated by the fourth step 282 of FIG. 8A. (This may be indicated by placing the base runner player position markers 146 or 148 of FIG. 2 some distance along the base path from their assigned bases, as occurs in an actual game where the runners take a long lead to gain a greater advantage. Additional sockets, not shown, may be provided along the base path 106 of FIG. 1, as well as in other areas of the playing field 100, as desired.)

Play continues with the pitcher (defense) rolling the dice per the method described further above, with the batter (offense) then rolling the dice to determine the outcome of any simulated hit, as indicated by the fifth and sixth steps 284 and 286 of FIG. 8A. The fifth step 284 provides for a simulated deep outfield hit to allow sufficient time for baserunners to advance two bases, i. e., a runner on first advances to third, and a runner on second reaches home plate to score. This is indicated by the seventh step 288 of FIG. 8A. A shorter hit to zones 2 through 6 advances any runners only one base, as indicated by the eighth step 290 of FIG. 8A. Play then returns to FIG. 5A, as shown by the ninth step 292.

In an actual game, a hitter will get a single or multiple base hit less than half the time during a hit and run play. The present simulated baseball game recognizes this, and provides for other alternatives than the single and multiple base hit scenarios of the fifth and sixth steps 284 and 286 of FIG. 8A, described above. As in earlier described rules of play, the defense (fielding) player or team rolls the dice after any simulated hit by the batter, as indicated generally by the tenth step 294 of FIG. 8A. If the defense rolls any doubles or the same number of the zone to which the ball was hit by the batter, the result is considered to be an out by the batter, in accordance with steps 230 and 232 of FIG. 5B. Doubles are considered to be a catch of an infield fly with the runners returning to their bases with no advance, in accordance with the eleventh step 296 of FIG. 8A.

However, in the event that the defense (fielding) rolls doubles per the tenth step 294 of FIG. 8A, then the defense is permitted a "special roll," in accordance with the first step 298 of FIG. 8B. If the defense then rolls a second consecutive doubles (any doubles), as indicated by the second step 300 of FIG. 8B, then the play is considered to be a double play, as indicated by the third step 302 of FIG. 8B, depending of course upon the number of baserunners on base and the number of outs.

Another means by which a double play may be achieved by the defense, is any roll equalling one of the base zone numbers of a baserunner. In this scenario, the batter is considered out (due to the catch of the infield fly per step 294 of FIG. 8A), and the number equal to the base zone of the baserunner, is counted as a second out for that baserunner, in accordance with steps 300 and 302 of FIG. 8B. The only means for the batter to "break up" the double play (or triple play, as discussed below), is by rolling any doubles during his/her turn at bat, thus precluding any opportunity for the defense to take a "special roll."

The present game also provides for a simulated triple play, by means of a specific numerical combination thrown by the defense during the "special roll" step 300 of FIG. 8B: Any roll equal to the zone numbers of any two bases, is considered to result in outs for any baserunners on those two bases. As an example, if the defense rolls a five and a six during the "special roll" step 304 of FIG. 8B, equal to the zones of second and first base, respectively, then any baserunners on those two bases would be considered out. As the batter was declared out due to the previous rolling of doubles during the infield fly catch step 294 of FIG. 8A, the result is a triple play in accordance with step 306 of FIG. 8B, assuming no outs and runners on first and second bases during the simulated game. A special roll of four and five would result in outs for baserunners on third and second, while a special roll of four and six would be considered as outs for baserunners on third and first. (Other scenarios with more outs existing before the play would be considered a fielder's choice to end the inning, as it would not be possible to achieve a triple play if any outs had previously been achieved during that half of the inning.) Thus, a double play may occur with none or one out and with only a single runner on base, but a triple play cannot occur unless there are no outs and at least two runners on base, and the defense rolls either a four and five, four and six, or five and six (with runners on those bases) on the "special roll" step 300 of FIG. 8B, after rolling doubles to simulate a catch of an infield fly. The odds of a triple play occurring are thus considerably lower than those for a double play, in keeping with actual baseball probabilities.

Any other combination is considered as an out by the batter with all runners remaining in position on their respective bases, in accordance with the sixth step 308 of FIG. 8B. It will be seen that the odds of rolling an additive total of four, five, or six with the dice are 12/36, or about 33.33%. Thus, a simulated force out will occur about one in three plays during a hit and run play, assuming a runner is on that base. As rolling doubles to create a simulated double play will occur about 16.67% of the time, it will be seen that the batter will be out at the plate with no runner advance during 50% of the "special roll" plays by the defense. Either result leads to the return to the starting point of FIG. 5A for the next play, as indicated by the seventh step 310 of FIG. 8B.

In summary, the present simulated baseball game and method of play provides a quite realistic representation of the actual game of baseball in accordance with its various rules of play. The present game is completely reliant upon chance means (a pair of dice, or equivalent chance means) for determining the outcome of each play, but the rules provide for the batter (offense) to make certain decisions during the course of play, depending upon the situation of the game, which may affect the outcome.

Thus, the present game is affected not only by pure chance, but also according to any strategic decisions made by the offense during the simulated batting operations of the game. A player who is knowledgeable about the game of baseball may thus be provided with some advantage or "edge" in ascertaining appropriate points during the course of play for attempting simulated steals, tagging up, or hit and run plays, in accordance with the status of the game at any given point. Yet, the present game provides a great leveling of skills due to the chance means employed, so the novice is not at a total disadvantage to the more experienced player.

The present game and its method of play also lend themselves well to a means of recording the action during a game, much like a "box score" kept for conventional baseball games. Each roll of the dice and batter's decision may be recorded in a simple shorthand method, if so desired. An example of such is:

*BS-P*(2,3)–*B*(3,4)–*D*(2,2)

The above shorthand symbolism indicates that (a) the batter swung at the pitch (rather than taking); (b) the dice roll by the pitcher resulted in a two and a three, or a non-doubles odd total, resulting in a contact swing by the batter; (c) the batter rolled the dice, achieving a four and three for an additive total of seven, simulating a ball hit to zone 7 of the playing field; and (d) the defense then rolled the dice for a count of four (double twos), resulting in a simulated fly out by the batter. It will be seen that the above scoring system may also be represented graphically, by pictorially indicating the numbers of each die.

Accordingly, the present simulated baseball game contains all of the critical elements and rules of play of an actual baseball game, including certain elements of strategy, scoring, recording of box scores, etc. These elements will serve to retain the interest of the serious baseball fan, while still allowing the neophyte to enjoy the game due to the use of dice (or equivalent chance means) for the determination of the outcome of each play after an initial batter decision, depending upon the situation of the game. The use of dice (or equivalent) also provides a very concise shorthand for keeping a "box score" of any game played according to the present apparatus and method of play, allowing players to recreate virtually any game and situation as desired. The present game also lends itself well to electronic play, with the basic methodology described herein, being readily adaptable to electronic play by means of appropriate computer programming and software. The present game will also be seen to be adaptable for casino play as well, with participating and spectating players making wagers on the outcome of the overall game, as well as on the outcome of various situations (base stealing, hit and run plays, etc.) as those situations occur during the course of play. Accordingly, the present game will prove to be popular with virtually any casual or serious fan of baseball, and will provide hours of entertainment for such persons.

It is to be understood that the present invention is not limited to the embodiments described above, but encompasses any and all embodiments within the scope of the following claims.

I claim:

1. A method of playing a simulated baseball game, comprising the following steps:

(a) providing chance means for randomly forming the additive numbers from two through twelve therewith, in accordance with the probabilities provided by means of a pair of cubical dice;

(b) providing a playing area having at least an infield, an outfield, an outfield wall, a home plate, first, second, and third bases, and a scoreboard disposed therewithin;

(c) dividing and separating the infield, outfield, and outfield wall into eleven zones, and defining areas of play corresponding to the additive numbers from two through twelve by means of the zones;

(e) distributing the zones upon the infield, outfield, and outfield wall of the playing area in a predetermined pattern in accordance with the probability of actual play in a corresponding actual playing area in an actual baseball game;

(f) selecting a home team and a visitor team;

(g) beginning play by an offense first batter deciding to take or simulate a swing at a simulated pitch;

(h) using the chance means by a defense pitcher for determining the outcome of a simulated pitch;

(i) using the chance means by the batter for determining the outcome of any simulated contact swing;

(j) using the chance means by the defense for determining the outcome of any simulated ball in play;

(k) continuing in the above manner in accordance with the conventional rules of the game of baseball; and (l) simulating the stealing of a base by:

(i) declaring a steal attempt by the batter, after the pitcher uses the chance means for determining the pitch;

(ii) using the chance means by the offense for determining the outcome of a simulated turn at bat;

(iii) counting the play as a simulated stolen base for any doubles or number pair equalling the two zones of the subject bases; and (iv) counting the play as a simulated base runner out for any non-double number and number pair not equal to the two zones of the subject bases.

2. The method of playing a simulated baseball game according to claim 1, wherein the step of using the chance means by a pitcher for determining the outcome of a simulated pitch further comprises the steps of:

(a) simulating a called strike for any odd number additive total or doubles, when the batter is simulating taking a pitch;

(b) simulating a called ball for any even, non-doubles additive total, when the batter is simulating taking a pitch;

(c) simulating a check swing and called ball for any even, non doubles additive total when the batter is simulating swinging at a pitch; and (d) simulating a pitch in the strike zone and a swing by the batter for any odd number additive total when the batter is simulating swinging at a pitch.

3. The method of playing a simulated baseball game according to claim 1, wherein the step of using the chance means by the batter for determining the outcome of any contact swing further comprises simulating the travel of the ball to the zone of the playing field corresponding to the additive total of the chance means.

4. The method of playing a simulated baseball game according to claim 1, wherein the step of using the chance means by the defense for determining the outcome of any simulated ball in play further comprises the steps of:

(a) simulating the travel of the ball to the zone of the playing field corresponding to the additive total of the chance means by the offense;

(b) counting the play as an out for any doubles or additive total equal to the number of the zone indicated by the chance means of the offense, by the defense; and (c) counting the play as a single or multiple base hit for any non-doubles total other than seven by the defense.

5. The method of playing a simulated baseball game according to claim 1, including the steps of:

(a) forming a playing area group consisting of a game board and an electronic video representation; and (b) selecting the playing area from the game board and electronic video representation of the playing area group.

6. The method of playing a simulated baseball game according to claim 5, including the steps of:

(a) providing a plurality of player position markers for indicating simulated progress about the bases of the game board;

(b) further providing a plurality of score and status indicators for indicating the score and status of the game; and (c) providing respective means for positively positioning the player position markers at least upon the bases of the game board and for positively positioning the score and status indicators upon the scoreboard of the game board.

7. The method of playing a simulated baseball game according to claim 6, including the step of forming the player position markers to resemble base runners.

8. A method of playing a simulated baseball game, comprising the following steps:

(a) providing chance means for randomly forming the additive numbers from two through twelve therewith, in accordance with the probabilities provided by means of a pair of cubical dice;

(b) providing a playing area having at least an infield, an outfield, an outfield wall, a home plate, first, second, and third bases, and a scoreboard disposed therewithin;

(c) dividing and separating the infield, outfield, and outfield wall into eleven zones, and defining areas of play corresponding to the additive numbers from two through twelve by means of the zones;

(e) distributing the zones upon the infield, outfield, and outfield wall of the playing area in a predetermined pattern in accordance with the probability of actual play in a corresponding actual playing area in an actual baseball game;

(f) selecting a home team and a visitor team;

(g) beginning play by an offense first batter deciding to take or simulate a swing at a simulated pitch;

(h) using the chance means by a defense pitcher for determining the outcome of a simulated pitch;

(i) using the chance means by the batter for determining the outcome of any simulated contact swing;

(j) using the chance means by the defense for determining the outcome of any simulated ball in play;

(k) continuing in the above manner in accordance with the conventional rules of the game of baseball; and (l) simulating the tagging up of a runner by:

(i) using the chance means by the offense for determining the outcome of a simulated turn at bat;

(ii) declaring a tag up when the batter receives a simulated hit to any of zones ten through twelve;

(iii) using the chance means by the defense; and (iv) declaring the at least one simulated tagging runner out on any doubles; and (v) declaring the at least one simulated tagging runner safe for any other number.

9. The method of playing a simulated baseball game according to claim 8, wherein the step of using the chance means by a pitcher for determining the outcome of a simulated pitch further comprises the steps of:

(a) simulating a called strike for any odd number additive total or doubles, when the batter is simulating taking a pitch;

(b) simulating a called ball for any even, non-doubles additive total, when the batter is simulating taking a pitch;

(c) simulating a check swing and called ball for any even, non-doubles additive total when the batter is simulating swinging at a pitch; and (d) simulating a pitch in the strike zone and a swing by the batter for any odd number additive total when the batter is simulating swinging at a pitch.

10. The method of playing a simulated baseball game according to claim 8, wherein the step of using the chance means by the batter for determining the outcome of any contact swing further comprises simulating the travel of the ball to the zone of the playing field corresponding to the additive total of the chance means.

11. The method of playing a simulated baseball game according to claim 8, wherein the step of using the chance means by the defense for determining the outcome of any simulated ball in play further comprises the steps of:

(a) simulating the travel of the ball to the zone of the playing field corresponding to the additive total of the chance means by the offense;

(b) counting the play as an out for any doubles or additive total equal to the number of the zone indicated by the chance means of the offense, by the defense; and (c) counting the play as a single or multiple base hit for any non-doubles total other than seven by the defense.

12. The method of playing a simulated baseball game according to claim 8, including the steps of:

(a) forming a playing area group consisting of a game board and an electronic video representation; and (b) selecting the playing area from the game board and electronic video representation of the playing area group.

13. The method of playing a simulated baseball game according to claim 12, including the steps of:

(a) providing a plurality of player position markers for indicating simulated progress about the bases of the game board;

(b) further providing a plurality of score and status indicators for indicating the score and status of the game; and (c) providing respective means for positively positioning the player position markers at least upon the bases of the game board and for positively positioning the score and status indicators upon the scoreboard of the game board.

14. The method of playing a simulated baseball game according to claim 13, including the step of forming the player position markers to resemble base runners.

15. A method of playing a simulated baseball game, comprising the following steps:

(a) providing chance means for randomly forming the additive numbers from two through twelve therewith, in accordance with the probabilities provided by means of a pair of cubical dice;

(b) providing a playing area having at least an infield, an outfield, an outfield wall, a home plate, first, second, and third bases, and a scoreboard disposed therewithin;

(c) dividing and separating the infield, outfield, and outfield wall into eleven zones, and defining areas of play corresponding to the additive numbers from two through twelve by means of the zones;

(e) distributing the zones upon the infield, outfield, and outfield wall of the playing area in a predetermined pattern in accordance with the probability of actual play in a corresponding actual playing area in an actual baseball game;

(f) selecting a home team and a visitor team;

(g) beginning play by an offense first batter deciding to take or simulate a swing at a simulated pitch;

(h) using the chance means by a defense pitcher for determining the outcome of a simulated pitch;

(i) using the chance means by the batter for determining the outcome of any simulated contact swing;

(j) using the chance means by the defense for determining the outcome of any simulated ball in play;

(k) continuing in the above manner in accordance with the conventional rules of the game of baseball; and (l) simulating a hit and run play by:

(i) declaring a hit and run attempt by the batter, before the pitcher uses the chance means for determining the pitch;

(ii) using the chance means by the offense for determining the outcome of a simulated turn at bat;

(iii) counting the play as a simulated successful two base advance hit and run play for any simulated hit to zones seven through eleven;

(iv) counting the play as a simulated successful one base advance hit and run play for any simulated hit to zones two through six;

(v) using the chance means by the defense for determining the outcome of any simulated contact other than a hit to zones two through eleven;

(vi) counting any doubles by the defense as a simulated catch of an infield fly;

(vii) providing a special use of the chance means by the defense for any doubles;

(viii) counting the play as a simulated double play for any number corresponding to a base zone having a baserunner or doubles achieved by the special chance means use by the defense;

(ix) counting the play as a simulated triple play for any numbers corresponding to two different base zones each having a baserunner; and (x) counting the play as a simulated out by the batter and no runner advance for any other number achieved by the special chance means use.

16. The method of playing a simulated baseball game according to claim 15, wherein the step of using the chance means by a pitcher for determining the outcome of a simulated pitch further comprises the steps of:

(a) simulating a called strike for any odd number additive total or doubles, when the batter is simulating taking a pitch;

(b) simulating a called ball for any even, non-doubles additive total, when the batter is simulating taking a pitch;

(c) simulating a check swing and called ball for any even, non-doubles additive total when the batter is simulating swinging at a pitch; and (d) simulating a pitch in the strike zone and a swing by the batter for any odd number additive total when the batter is simulating swinging at a pitch.

17. The method of playing a simulated baseball game according to claim 15, wherein the step of using the chance means by the batter for determining the outcome of any contact swing further comprises simulating the travel of the ball to the zone of the playing field corresponding to the additive total of the chance means.

18. The method of playing a simulated baseball game according to claim 15, wherein the step of using the chance means by the defense for determining the outcome of any simulated ball in play further comprises the steps of:

(a) simulating the travel of the ball to the zone of the playing field corresponding to the additive total of the chance means by the offense;

(b) counting the play as an out for any doubles or additive total equal to the number of the zone indicated by the chance means of the offense, by the defense; and (c) counting the play as a single or multiple base hit for any non-doubles total other than seven by the defense.

19. The method of playing a simulated baseball game according to claim 15, including the steps of:

(a) forming a playing area group consisting of a game board and an electronic video representation; and (b) selecting the playing area from the game board and electronic video representation of the playing area group.

20. The method of playing a simulated baseball game according to claim 19, including the steps of:

(a) providing a plurality of player position markers for indicating simulated progress about the bases of the game board;

(b) further providing a plurality of score and status indicators for indicating the score and status of the game; and (c) providing respective means for positively positioning the player position markers at least upon the bases of the game board and for positively positioning the score and status indicators upon the scoreboard of the game board.

* * * * *